United States Patent [19]

Schuck

[11] 4,179,042

[45] Dec. 18, 1979

[54] SEALED DISPENSER SPOUT ASSEMBLY

[76] Inventor: William H. Schuck, 9338 Perrin Beitel, Apt. #902, San Antonio, Tex. 78217

[21] Appl. No.: 828,305

[22] Filed: Aug. 29, 1977

[51] Int. Cl.[2] ..... B67B 7/26

[52] U.S. Cl. ..... 222/89; 222/106; 222/56; 220/85 SP

[58] Field of Search ..... 222/89-91, 222/567, 569, 92, 107, 106; 220/85 SP; 206/532

[56] References Cited

U.S. PATENT DOCUMENTS

| | | | |
|---|---|---|---|
| 3,002,657 | 10/1961 | Liljemark | 222/89 |
| 3,144,866 | 8/1964 | Ellis | 128/DIG. 24 |
| 3,530,858 | 9/1970 | Edwards | 222/567 X |

FOREIGN PATENT DOCUMENTS

| | | | |
|---|---|---|---|
| 2353010 | 4/1975 | Fed. Rep. of Germany | 222/90 |
| 2525000 | 12/1976 | Fed. Rep. of Germany | 222/89 |

*Primary Examiner*—Robert J. Spar
*Assistant Examiner*—Charles A. Marmor
*Attorney, Agent, or Firm*—Brown & Martin

[57] ABSTRACT

A spout assembly is adapted to be secured to and sealably communicated with the interior of a flexible bag containing a liquid or pliable material therein for draining the material from the bag without loss through leakage. The assembly is comprised of a nozzle, a portion of which is to be inserted into the bag, at least one clamping member which is carried by the nozzle for holding the bag in sealing engagement with the exterior surface of the nozzle and locking lugs for maintaining the sealed engagement and preventing leakage about the nozzle while the material within the bag is drained therefrom.

7 Claims, 7 Drawing Figures

SEALED DISPENSER SPOUT ASSEMBLY

BACKGROUND OF THE INVENTION

The present invention relates to a spout assembly which can be readily secured to and sealably communicated with the interior of a flexible bag container for the purpose of draining the contents therefrom without incurring any leakage of such contents or, in the case of materials having poisonous fumes such as urethane systems, without emitting any undesirable quantity of poisonous vapor. The problem of transferring liquid or pliable materials such as grease, paste or putty-like material from their storage containers in a controlled manner has taken a new direction with the increased use of flexible bag containers such as those constructed of polyethylene, foil or other thin film material. This growth has resulted from the low cost of such bags as well as the increase in multi-compartmented mixing bags such as those described in U.S. Pat. Nos. 3,809,224 and 2,756,874 wherein the bag is divided into separate compartments by a clamping member and different components are stored in each compartment. These components are subsequently mixed together within the bag solely by removing the separating clamp therefrom and subsequently dispensed from the bag in a mixed state. A commom example for the use of such bags is with thermalsetting resin wherein the epoxy resin and curing agent must be stored separately due to the short pot life of the resulting mixture. It is heretofore been the practice when using such flexible container bags to merely sever a corner from the bag after mixing and pour the contents through the formed openings. The disadvantages of this method are numerous. It is quite difficult to pour a controlled quantity of liquid material through such openings, particularly a highly viscous material such as epoxy resins. When pouring, a certain amount of material will almost always leak to undesirable areas which often times is highly detrimental, and, it is extremely difficult to contain any vapors emanating from the material while it is being openly poured from the bag. When transferring materials giving off toxic vapors, such a problem is substantial.

Because of the transfer problems resulting from the use of such bags, their use has been somewhat curtailed and alternate mixing and dispensing systems have been developed. Such systems are, however, considerably more expensive and from that standpoint, undesirable. An example of such a system which is used for dispensing epoxy resin is the Semco kit which is covered by U.S. Pat. No. 3,144,966. It would be highly desirable to provide a pouring or spout assembly which is compatible with the less expensive flexible bags, is simple to use, economical to produce and which obviates the problem of leakage, both of the material itself and the vapors which are given off thereby. Such an assembly is disclosed herein.

SUMMARY OF THE INVENTION

Briefly, the invention comprises a pouring or spout assembly which is readily secured to and sealably communicated with the interior of a flexible bag container for draining the material contained therein. The assembly includes a nozzle which is to be inserted into the bag and means for holding the bag in sealing engagement with the exterior surface of the nozzle to prevent any leakage about the exterior thereof while material is being transferred therethrough.

It is therefore the principal object of the present invention to provide a spout assembly for a flexible bag container which allows material to be passed from the bag through the nozzle without leakage.

It is another object of the present invention to provide a spout assembly which is easily secured to and sealably communicated with the interior of a flexible bag container for draining the material from the bag without leakage.

It is yet another object of the present invention to provide a spout assembly for a flexible bag container which is of simple construction and economical to manufacture.

These and other objects and advantages of the present invention will become apparent from the following detailed description taken in conjunction with the accompanying drawings.

DESCRIPTION OF THE PREFERRED EMBODIMENT

In the Drawings

Figure 1:
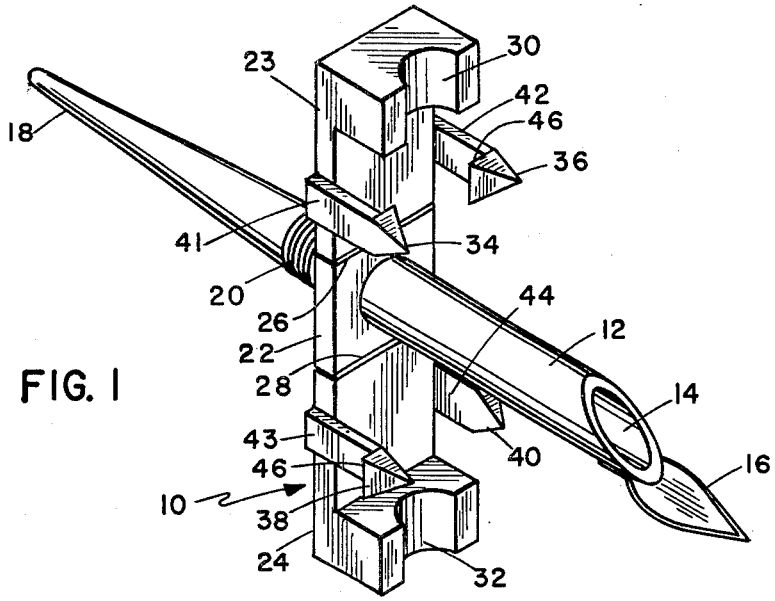
FIG. 1 is a perspective view of the spout assembly.

Referring now in detail to the drawings, the dispenser spout assembly 10 is comprised of a hollow nozzle 12 having an angularly disposed inlet opening 14 at one end thereof, a piercing member 16 projecting from said opening, a closed outlet 18 at the other end thereof and a threaded portion 20 for securing the assembly 10 to a threaded port (not shown) of a receiving container or transfer conduit. A base member 22 is disposed about the nozzle adjacent the threaded portion 20 and a pair of locking arms 23 and 24 are hingedly connected to opposite sides of the base member at 26 and 28. The locking arms 23 and 24 are constructed of a flexible material and carry U-shaped clamping members 30 and 32 at the extended ends thereof and interlocking lugs 34, 36, 38 and 40 which extend from transverse arms 41, 42, 43 and 44 respectively. Each of the lugs is pointed at its extended end for piercing a bag container in a manner to be described and defines an engaging surface 46. It can be seen that the engaging surfaces on lugs 34 and 36 are inwardly disposed of the lugs while the engaging surfaces on lugs 38 and 40 are outwardly disposed such that upon drawing locking arms 23 and 24 together about the nozzle 12, the clamping members 30 and 32 grip the external surfaces of the nozzle and the engaging surfaces 46 of lugs 34 and 36 mate with the engaging surfaces 46 on lugs 38 and 40 thereby securing the clamping members in place about the nozzle.

Figure 2:
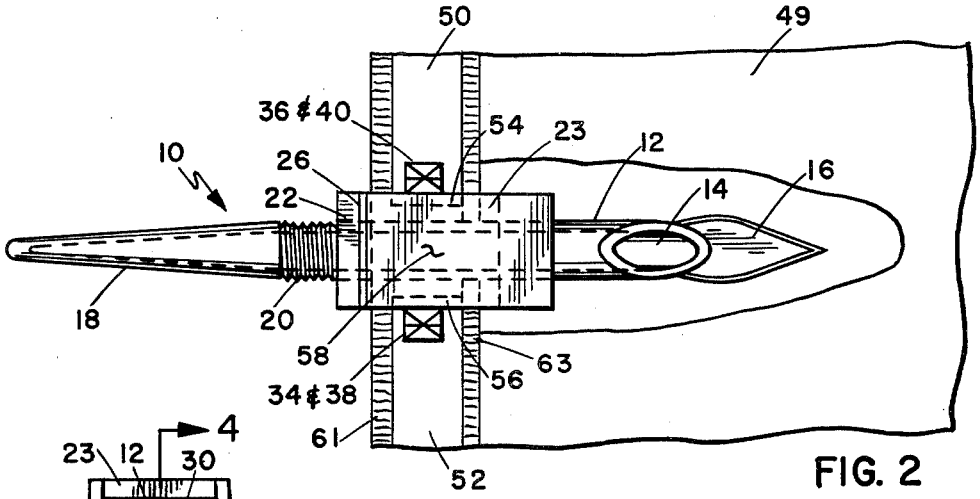
FIG. 2 is a plan view of the spout assembly and flexible bag container.

While the dispensing spout assembly 10 is easily used with any flexible bag container sealed in a conventional manner, a flexible bag container 49 which is particularly adapted for use with the dispensing spout assembly 10 is illustrated in FIG. 2. As shown therein, the bag is provided with a pair of lateral areas 50 and 52 which are isolated from the remainder of the interior of the bag by seals 54 and 56 and which define a central passageway 58 terminating in an end seal 61 and interior seal 63 which extend across the bag sealing that end thereof and lateral areas 50 and 52 from the remainder of the bag. If desired, seal 63 could be divided into two separate seals, each extending from the lateral edge of the bag inwardly to seals 54 and 56. In such an embodiment, the central passageway 58 would be sealed solely by end seal 61.

To drain the contents of the bag, the piercing member 16 which extends from the nozzle 12 is inserted through the end seal 61 and the open end of the nozzle is pushed into the passageway 58 of the bag and through seal 63 communicating the inlet openings 14 of the nozzle with the bag interior. The locking arms 23 and 24 are then pivoted toward the bag such that clamping members 30 and 32 hold a portion of the exterior of the bag 49 tightly against the external surface of the nozzle 12 in sealing engagement therewith and the interlocking lugs 36, 40 and 34, 38 pierce through the isolated lateral areas 50 and 52 of the bag container. As the lugs pierce the bag container, the engaging surfaces 46 on lugs 34 and 36 mate with the surfaces 46 on lugs 38 and 40 and secure the clamping means in place about the bag and nozzle while avoiding any contact with the material held within the bag container.

Figure 3:
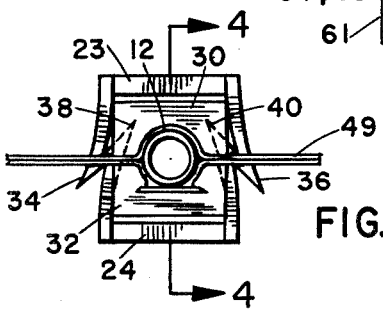
FIG. 3 is a front view of the spout assembly secured to the bag container.
Figure 4:
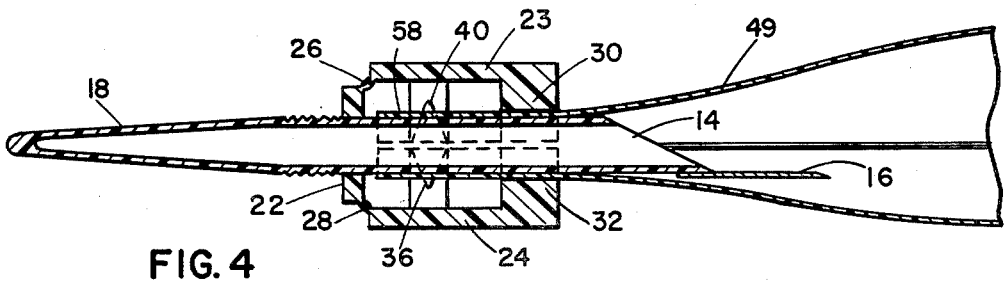
FIG. 4 is a sectional view taken along line 4—4 of FIG. 3.

As can be seen in FIGS. 3 and 4, the spout assembly is now sealably secured to the bag and is in communication with the interior thereof. If desired, after the bag is pierced but before the piercing member is inserted into the bag, the piercing member 16 can be broken off the nozzle 12 to avoid inadvertent puncturing of the flexible bag container from within. To drain the material from the bag container through the nozzle 12 it is only necessary to sever the closed end 18 of the nozzle and, if desired, secure the nozzle end 18 to a suitable container or transfer conduit.

Figure 5:
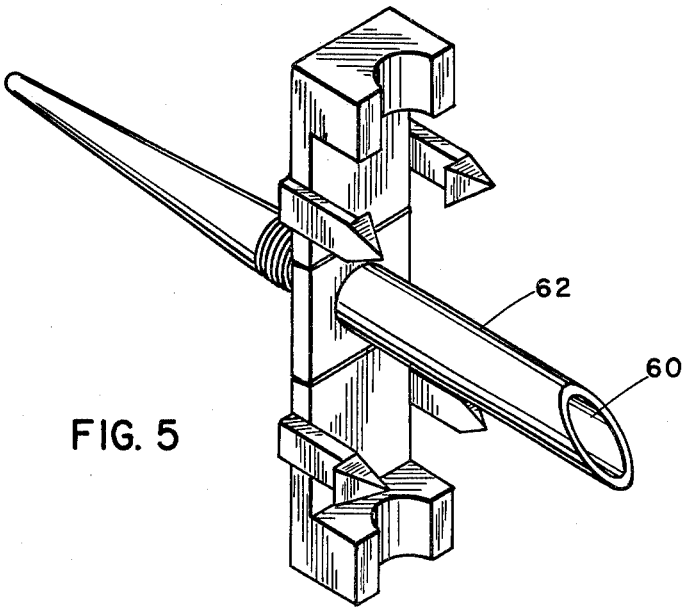
FIG. 5 is a perspective view of a second embodiment of the dispenser spout assembly.

A modified form of the dispenser spout assembly is illustrated in FIG. 5 wherein the open end 60 of the nozzle 62 is not provided with a piercing member as in the prior embodiment. Accordingly, to insert the nozzle within the bag, the lateral end seal 61 is cut therefrom and the open end of the nozzle merely inserted to communicate with the interior thereof. The assembly is then secured to the bag as in the prior embodiment.

Figure 6:
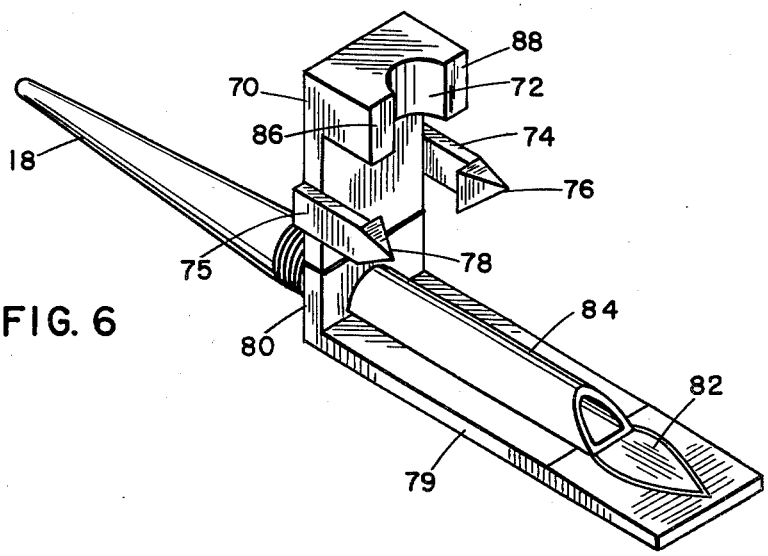
FIG. 6 is a perspective view of a third embodiment of the dispenser spout assembly.
Figure 7:
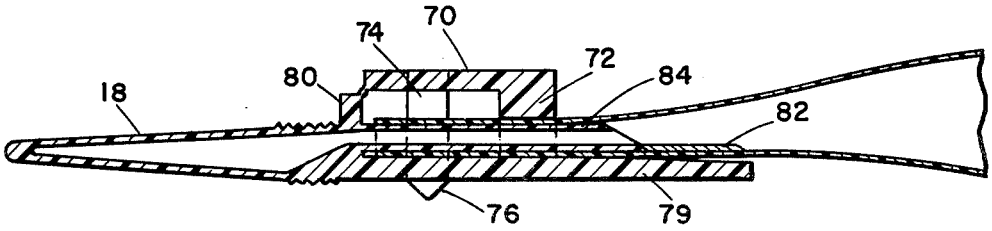
FIG. 7 is a sectional view illustrating the third embodiment of the dispenser spout assembly secured to and communicating with a flexible bag container.

A third embodiment of the apparatus is illustrated in FIGS. 6 and 7. This embodiment differs from the previous embodiments in that only a single clamping arm 70 is provided. Arm 70 is secured to the spout assembly in the same manner as in the first embodiment and carries a clamping member 72, transverse arms 74 and 75 and interlocking lugs 76 and 78. In this embodiment, the second locking arm has been replaced with a backing 79 which is affixed to the base member 80. In use, the piercing member 82 is inserted into the bag 49 in the same manner as piercing member 16 of the first embodiment and the nozzle is urged into the bag such that one side of the bag is disposed over the nozzle and the other side thereof is disposed between the underside of the nozzle and the assembly backing 79. The locking arm 70 is then pivoted into place such that the clamping member 72 presses the container bag against the top side 84 of the nozzle with the surfaces 86 and 88 of the clamping member abutting the assembly backing and interlocking lugs 76 and 78 engaging the underside of the assembly backing to press backing 79 against the underside of the nozzle as illustrated in FIG. 7. In this manner, the dispenser spout assembly is sealably secured about the nozzle which then communicates with the interior of the bag for subsequent use as described above.

Various other changes and modifications may be made in carrying out the present invention without departing from the spirit and scope thereof. Insofar as these changes and modifications are within the purview of the appended claims they are to be considered as part of the present invention.

I claim:

1. A spout assembly for use in dispensing material from a flexible bag container, said assembly comprising a nozzle having an open inlet end, said inlet end being adapted to be disposed within said container and securing means carried by said nozzle for securing a portion of said container about said nozzle in sealing engagement therewith upon said inlet end of said nozzle being disposed within said container;

said securing means comprises at least one flexible arm member hingedly secured to said nozzle and means carried by said arm member for pressing a portion of said container against said nozzle in sealing engagement therewith.

2. A spout assembly for use in dispensing material from a flexible bag container, said assembly comprising a nozzle having an open inlet end, said end being adapted to be disposed within said container, a pair of locking arms hingedly secured to opposite sides of said nozzle, a pair of clamping members for pressing a portion of said container against said nozzle in sealing engagement therewith, one of said members being secured to and carried by each of said arms and means for locking said clamping members about said portion of said container in sealing engagement with said nozzle.

3. The spout assembly of claim 2 wherein said locking means comprises a pair of locking lugs carried by each of said locking arms, the lugs carried by one of said locking arms being adapted to extend through a portion of said container to engage the lugs carried by the other of said locking arms on opposite sides of said nozzle thereby locking said clamping members about said portion of said container and said nozzle.

4. The spout assembly of claim 3 including means carried by said nozzle forwardly of the open end thereof for piercing said container such that said open end of said nozzle can be disposed within said container.

5. A spout assembly for use in dispensing material from a flexible bag container, said assembly comprising a nozzle having an open inlet end, said end being adapted to be disposed within said container, a support member carried by said nozzle and extending substantially parallel thereto, an arm member hingedly secured to said nozzle, clamping means carried by said arm member for pressing a portion of said container against said nozzle and said support member thereby sealably securing said container about said nozzle and means for locking said clamping means in place against said portion of said container.

6. The spout assembly of claim 5 wherein said locking means comprises a pair of locking lugs carried by said arm member, said lugs being adapted to engage said support member thereby holding said clamping means against said portion of said container.

7. The spout assembly of claim 6 wherein said open inlet end of said nozzle is angularly disposed with respect to the longitudinal axis of said nozzle, the forward end thereof defining means for piercing said container such that said open inlet end of said nozzle can be disposed within said container.

* * * * *